United States Patent [19]

Paske et al.

[11] Patent Number: 4,791,797

[45] Date of Patent: Dec. 20, 1988

[54] DENSITY NEUTRON SELF-CONSISTENT CALIPER

[75] Inventors: William C. Paske, Pearland; Paul F. Rodney, Spring; Ray A. Roeder, Houston, all of Tex.

[73] Assignee: NL Industries, Inc., New York, N.Y.

[21] Appl. No.: 161,227

[22] Filed: Feb. 17, 1988

Related U.S. Application Data

[63] Continuation of Ser. No. 843,043, Mar. 24, 1986, abandoned.

[51] Int. Cl.[4] ..... E21B 49/00; G01N 5/00

[52] U.S. Cl. ..... 73/152; 250/265; 367/35; 175/50

[58] Field of Search ..... 73/151, 152; 166/250; 367/86, 35, 25; 250/265, 270, 266, 269; 181/105; 175/40, 41, 50

[56] References Cited

U.S. PATENT DOCUMENTS

| | | | |
|---|---|---|---|
| 2,596,023 | 5/1952 | Goble et al. | 367/86 |
| 2,596,024 | 5/1952 | Goble et al. | 73/152 |
| 2,911,536 | 11/1959 | Scherbatskoy | 250/265 |
| 3,315,224 | 4/1967 | Ferguson | 73/151 |
| 3,321,625 | 5/1967 | Wahl | 250/266 |
| 3,330,374 | 7/1967 | Broussard et al. | 367/27 |
| 3,453,433 | 7/1969 | Alger et al. | 250/265 |
| 3,464,513 | 9/1969 | Roever | 367/35 |
| 3,483,376 | 12/1969 | Locke et al. | 250/265 |
| 3,517,767 | 6/1970 | Straus et al. | 367/104 |
| 3,590,940 | 7/1971 | Leger | 367/27 |
| 4,035,639 | 7/1977 | Boutemy et al. | 250/264 |
| 4,596,926 | 6/1986 | Coope | 250/266 |
| 4,665,511 | 5/1987 | Rodney et al. | 73/152 |

*Primary Examiner*—Tom Noland
*Assistant Examiner*—Robert R. Raevis
*Attorney, Agent, or Firm*—Browning, Bushman, Zamecki & Anderson

[57] ABSTRACT

Two downhole measurement-while-drilling tools, at least one of which is borehole sensitive, are used to make standard measurements of borehole conditions while drilling. From these measurements, and with some prior knowledge of the lithology, the caliber of the borehole is determined by iteration. The preferred tools are a neutron porosity and a density tool with lithology having been determined by prior seismic survey techniques.

21 Claims, 3 Drawing Sheets

DENSITY NEUTRON SELF-CONSISTENT CALIPER

This is a continuation of application Ser. No. 843,043 filed on Mar. 24, 1986 and now abandoned.

BACKGROUND OF THE INVENTION

1. Field of the Invention

The present invention relates to a method and apparatus to calibrate a borehole during a drilling operation by taking two measurements of the same formation with two different tools to determine borehole caliber through an iteration process. The tools employed are borehole and lithology sensitive measuring-while-drilling tools.

2. Description of the Prior Art

There have been many devices and methods developed for calibrating a borehole to achieve an accurate profile of the walls of the hole. However, none of these devices have been capable of making the measurements while the drilling operation is being carried out. For the most part, they are wireline devices which are used to log the well hole after the drill string has been withdrawn. Examples of such wireline devices can be found in U.S. Pat. Nos. 2,596,023; 2,596,024; 3,330,374; 3,464,513; 3,517,767; and 3,590,940.

Clearly, there are many advantages which could be achieved by recording the caliper profile of a borehole during the drilling operation. Among the advantages of such a caliper measurement would be to provide warning to the driller that the walls of the borehole are collapsing or closing causing a narrowing or necking of the borehole which could prevent withdrawal of the drill and possibly even gripping the drill string with sufficient force to interrupt the rotary drilling. In a similar way, such a caliper would provide warning that the borehole walls are sloughing in such a manner as to form a large cavity, creating a lot more debris which would necessarily have to be removed and would slow the drilling operation. The driller would then have the option of stabilizing the well before serious damage was done. Another use of a caliper measurement taken while drilling would be to allow borehole correction of formation sensing tools in the same manner as used in wireline logging.

Most wireline tools, because they are not used for some time after a well is drilled, encounter a problem in dealing with the mud cake which begins to form on the borehole walls shortly after drilling. The present invention overcomes this problem by using tools which are in the drill string closely spaced from the drill bit and therefor make their respective measurements prior to development of appreciable mud cake. Further, the present invention does not require physical contact with the borehole wall, as for example, with a six arm caliper or the asymmetrically operated devices which actually penetrate the mud cake. Such mechanical calipers clearly cannot be used while drilling.

There is a limited amount of room available in a drill string for downhole tools. The present invention provides for maximum utilization by employing known formation measurement-while-drilling tools to make measurements which are uniquely utilized to iterate borehole caliber from their respective measurements, without adversely affecting the drilling operation.

SUMMARY OF THE INVENTION

The present invention utilizes two measurements of the same formation made by two different devices during a drilling operation to infer the borehole size. The invention requires that at least one measurement be taken by a tool which is borehole sensitive, at least one measurement taken by a tool which is lithology sensitive, and that there be some knowledge of the formation, either from earlier measurements or from well logging techniques. The present invention preferably uses a neutron porosity tool and a density tool, but resistivity, acoustic log, or any other known measuring-while-drilling tool which is borehole sensitive could also be used to make the measurements. The density of the formation is preferably measured first to infer what the neutron tool should see in the way of porosity. The measurements by each of the two tools are cross plotted to equate the readings. An iteration process is started to determine the best self-consistant borehole and porosity readings. The iteration process could be accomplished by any well known data processing equipment.

BRIEF DESCRIPTION OF THE DRAWINGS

The present invention will now be explained with reference to the accompanying drawings in which.

DESCRIPTION OF THE PREFERRED EMBODIMENT

Figure 1:
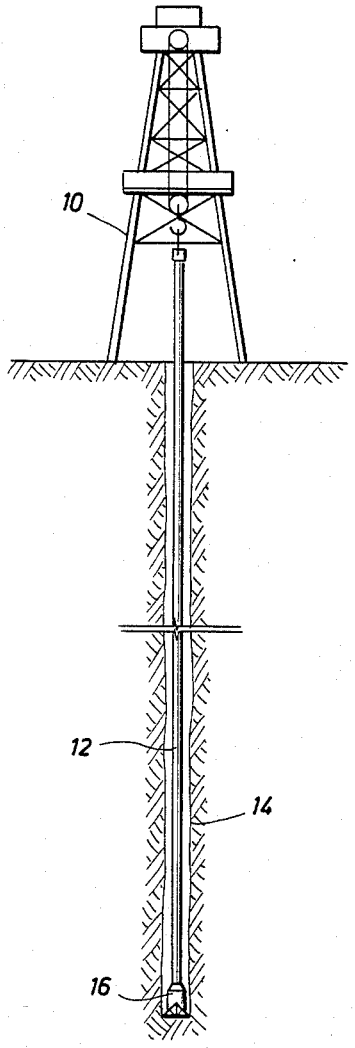
FIG. 1 is a diagrammatic side elevation of a typical well drilling operation which would benefit from the present invention.

Referring now to FIG. 1, there is shown a drilling rig 10 with a drill string 12 depending into a borehole 14. At the lower end of the drill string, there is a downhole assembly generally noted by reference numeral 16 and shown in somewhat greater detail in FIG. 2. The downhole assembly includes a drill bit 18 with a density measuring device 20 and porosity measuring device 22 mounted in an equipment sub 24 which is immediately adjacent to the drill bit 18. The drilling operation is conventional in that either means (not shown), such as a kelly and associated equipment, at the surface are used to rotate the drill string 12 thereby driving the bit 18 with a rotary motion against the lower end of the borehole 14 or a mud motor (also not shown) is used downhole to drive the bit. Simultaneously, drilling mud is pumped down the central bore of the drill string and bit 18 to flow back up the annulus between the drill string and the borehole walls carrying with the mud the debris generated from the drilling operation.

Figure 2:
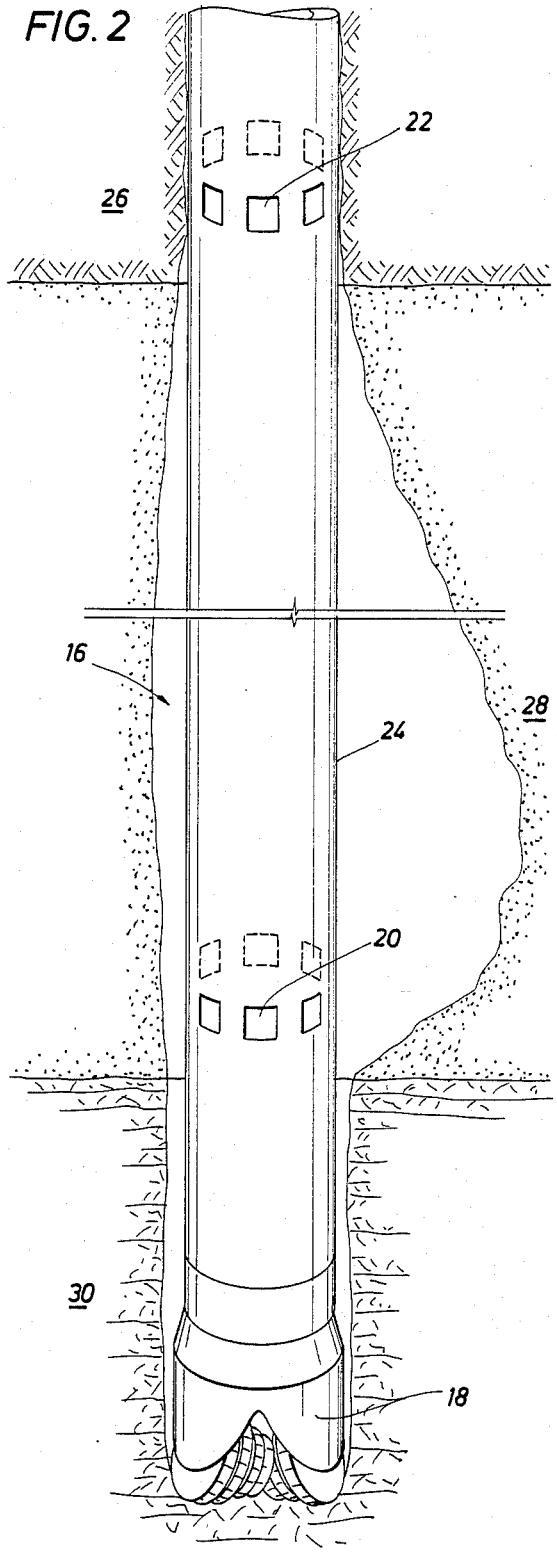
FIG. 2 is a diagrammatic side elevation, foreshortened, showing an instrument sub associated with a downhole assembly.

FIG. 2 illustrates three types of situations which can occur in a borehole. These situations suggest the need for constant monitoring of the borehole profile. In this Figure, the first strata 26 is shown collapsing to such an extent that it would form a neck in the borehole which would prevent withdrawal of the bit 18 and/or possibly jamming the drill string 12 so as to prevent continued rotation thereof. The second strata 28 is shown sloughing in such a manner as to cause a substantial enlargement of the borehole. This would result in additional material being generated which must be removed in the drilling operation. The third strata 30 is shown as a somewhat stable strata which is not collapsing either inwardly or outwardly. The strata 30 may, however, be somewhat asymmetric to illustrate a third possible condition, namely, the drill string being eccentric with respect to the borehole. This is not likely close to the drill bit but can occur further up the drill string and require the use of stabilizers (not shown) to maintain centering. It should be noted that the present invention will not determine asymmetry with respect to the borehole axis, but will indicate a change in the caliber caused by any eccentricity. Since the measurements are made while drilling, i.e. with the tooling sub rotating about its axis, such a measurement of eccentricity would not be practical since the sensors would be rotating and would therefore average the borehole diameter.

It is important to determine if any of the above conditions are occurring while the drilling operation continues. In the case of the necking in the first strata 26, it would be necessary to withdraw the drill string and to re-bore the strata to prevent the above-discussed loss of the bit and/or the drilling operation. Once the re-boring was completed, it would be desirable to monitor the area to see if further re-boring were to be required or if some form of hole stabilization were to be required.

In the instance of the second strata 28, it would be desirable to be able to profile the enlarged cavity area to determine its extent and rate of growth to determine whether or not hole stabilization was required. In this instance, a casing and cementing operation would most likely be utilized, but it would be necessary to determine the volume of the cavity defined by the borehole wall and casing in order to determine the quantity of cement required and when the cementing operation was completed.

The density measuring device 20 is shown simply as a block representation since any one of the many known types of such formation sensitive measuring-while-drilling sensors can be used. An example of one such device is the compensated gamma-gamma logging tool disclosed in U.S. Pat. No. 3,321,625. While this patent relates to a wireline tool, its principles could be adopted into a measuring-while-drilling tool. Likewise, the porosity measuring device 22 has been shown as a block as any known device, such as the neutron logging tools described in U.S. Pat. Nos. 3,483,376 and 4,035,639, could be used. Again these patents refer to wireline tools and, while their operational techniques are acceptable, the tools themselves would have to be extensively modified to physically withstand a downhole measuring-while-drilling environment. The primary criteria for the two measuring devices is that at least one of them must be a borehole dependent tool, meaning that the measurement relates to a characteristic of the borehole in the immediate vicinity of the tool. There are advantages to be gained if the tools are of different type, for example, neutron and resistivity, as this allows for some degree of cross check between the readings. There also must be a tool which is lithology sensitive, although this function can be served by prior seismic surveying or by using log offsets. In the case of an encounter with salt water, for example, this would throw neutron reading devices way off, some resistivity devices would not be so affected. Similarly, an encounter with gas would cause both density and porosity readings to show an apparent drop in formation density and porosity. This then would clearly show the presence of gas in the formation under investigation. Thus, the driller would receive an indication of a change in the condition within the borehole, but he would know that the change was not one of the physical dimensions of the borehole.

It should be noted that while there are a wide variety of known tools available for making the necessary porosity and density measurements, discretion must be exercised in the selection to choose those tools requiring the fewest corrections to compensate for other than borehole conditions.

The basic idea for the present invention is predicated on the observation that both a neutron porosity tool and a gamma-gamma density tool are borehole sensitive. When they are coupled with the well-known relationship between the neutron porosity and the density porosity cross plot, they provide means by which the caliber of the borehole can be inferred. However, some means of determining the formation type, i.e. the lithology, must also be available. This independent lithology identification can be based on a natural gamma ray log or by inference from resistivity measurements. By specifying the type of formation through which the tool is penetrating, e.g. sandstone, a continuous log of the inferred caliber may be determined. If the formation type is changing rapidly, the caliber dimension can still be inferred by choosing the formation for the region of interest. This measurement can be recorded in real time or it can be calculated for a specific region of the borehole at a later date.

Figure 3:
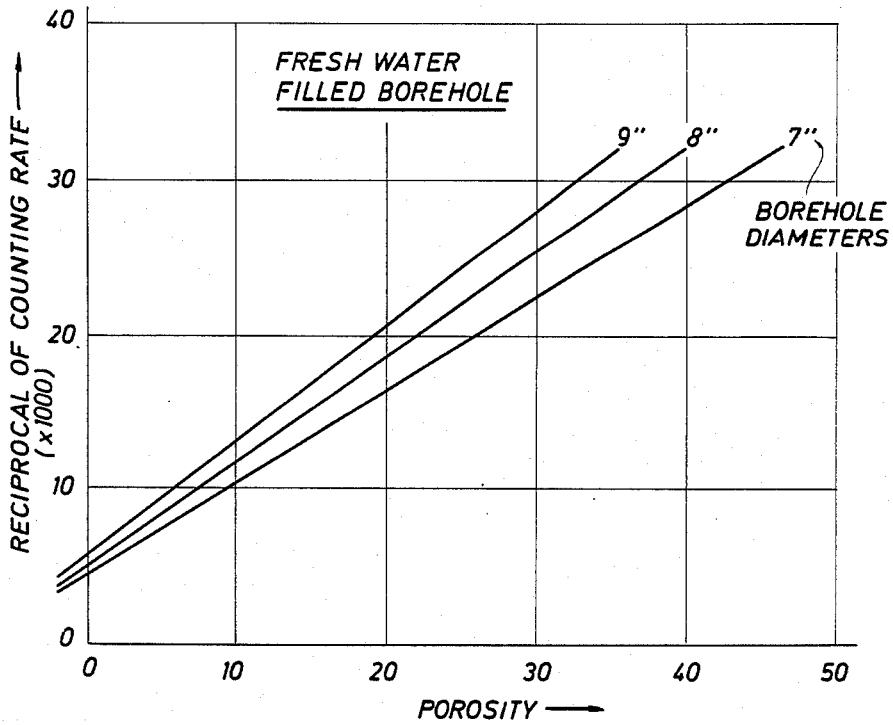
FIG. 3 is a graph of measurements taken by a compensated neutron porosity tool for different borehole sizes.

The reading of a neutron porosity tool is dependent upon the borehole diameter, as shown in FIG. 3. From these curves it is a simple matter to establish a functional dependence between the count rate observed N, the porosity of the formation $\phi_n$ and the borehole diameter BH. For example, in the case of a linear dependence:

$$\frac{1}{N} = \left(\frac{BH - b}{a}\right)\phi_n + \frac{BH}{c} \tag{1}$$

where a, b and c are constants determined when the tools are calibrated. The constants represent slopes and intercepts of calibration curves in different size boreholes. To first order approximations, only the constant b will change as the lithology changes. Consequently, we can now determine the porosity and borehole diameter if we can determine either the quantity of the porosity of the formation or the borehole diameter through independent measurement.

Figure 4:
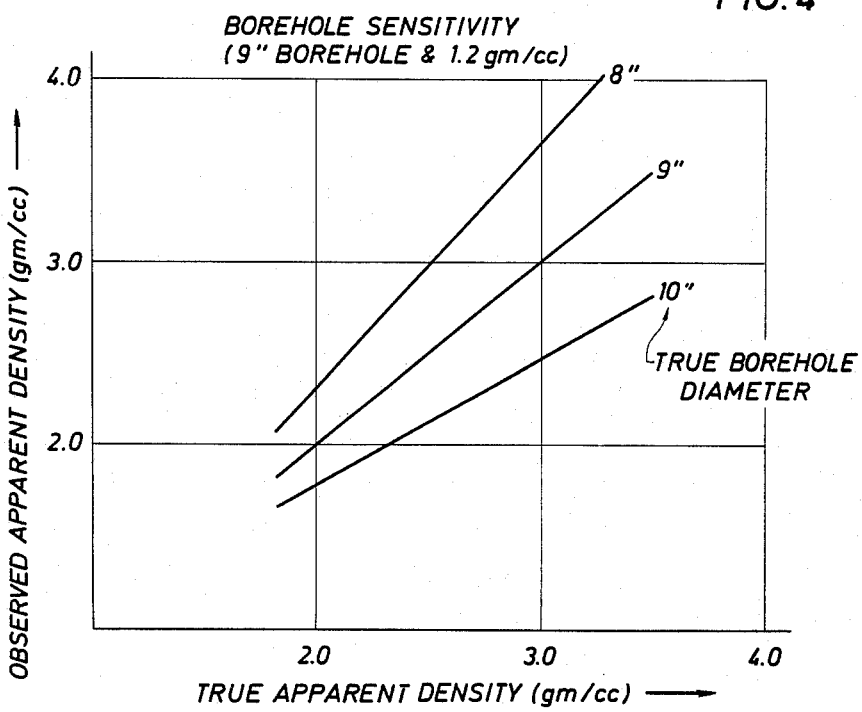
FIG. 4 is a plot of borehole dependence of a bulk density tool.
Figure 5:
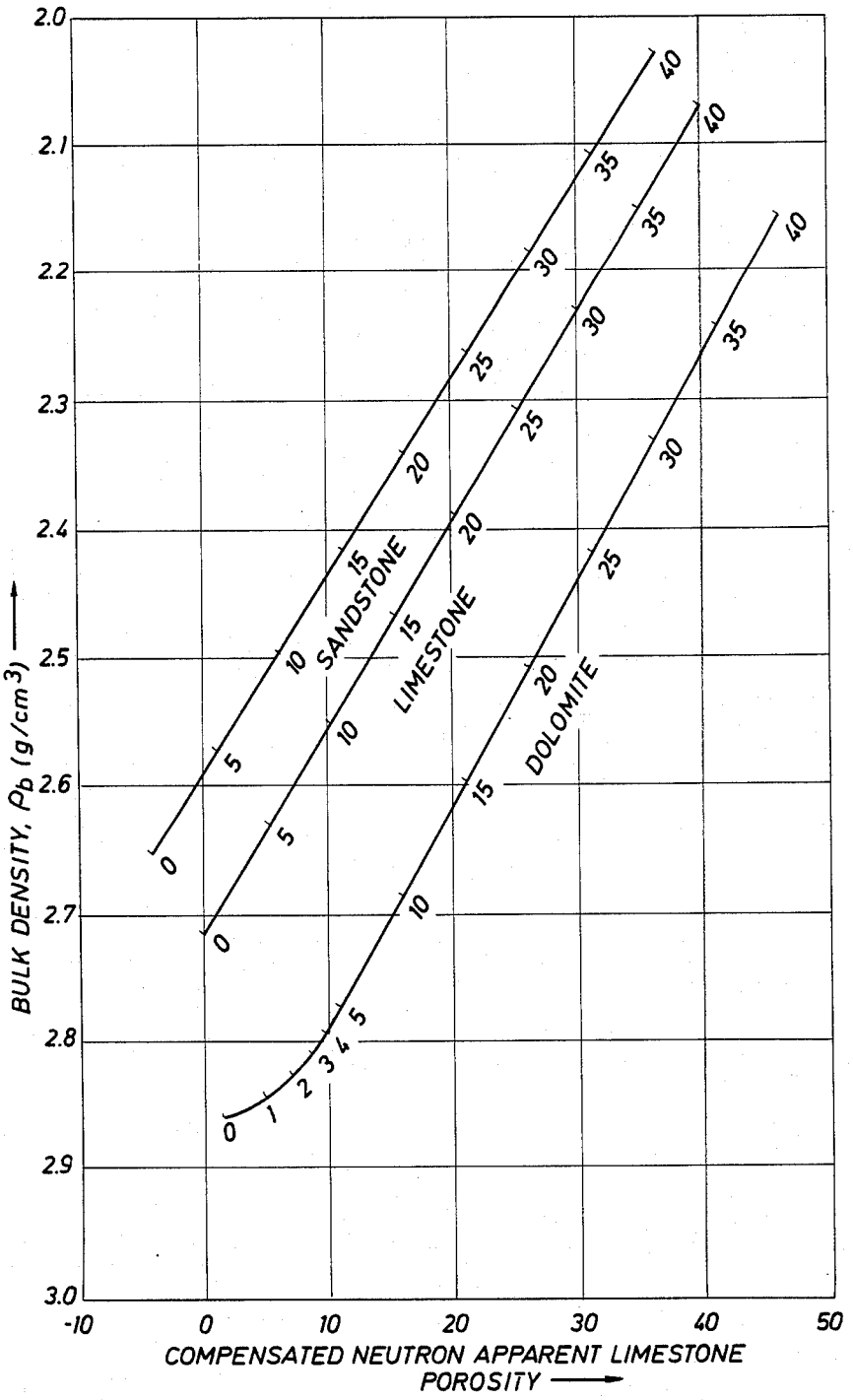
FIG. 5 is a standard cross plot to equate neutron porosity and density readings.

In a similar manner, a set of curves can be generated for a density tool in several different diameter boreholes as shown in FIG. 4. The functional dependence of the observed apparent density on the borehole diameter (BH) and the true apparent density can be established from these curves. If these curves are linear, the dependence would be:

$$(\rho'_{ma})_o = \frac{(BH - B)}{A}(\rho'_{ma})_t + \frac{BH}{C} \tag{2}$$

where $(\rho'_{ma})_o$ is the observed apparent density, $(\rho'_{ma})_t$ is the true apparent density, and A, B and C are constants representing the slopes and intercepts of the calibration curves. None of these constants are lithology dependent. It is also well known that the porosity of the formation can be determined from the apparent density of the formation through the expression:

$$\phi_D = \frac{\rho_{ma} - \rho_b}{\rho_{ma} - \rho_f} \quad (3)$$

where $\rho_{ma}$ is the density of the formation matrix, $\rho_f$ is the density of the fluid filling the interstitial pores in the formation, $\rho_b$ is the bulk or apparent formation density, and $\phi_D$ is the porosity derived from the density. Combining equations (2) and (3) provides an expression involving the formation porosity and the borehole diameter, which is:

$$(\rho_b)_o = \frac{(BH - B)}{A}[\rho_{ma} - \phi_D(\rho_{ma} - \rho_f)] + \frac{BH}{C}, \quad (4)$$

where $(\rho_b)_o$ is the observed formation density. If one assumes that the lithology of the formation can be determined either through a natural gamma ray log, a resistivity measurement, offset log knowledge or other means, one can use a standard cross plot as shown in FIG. 5 to equate the two porosity readings. With the scales shown in FIG. 5, either equation (2) or equation (4) could be used with equation (1) and the cross plot. It is now possible to compare the porosity readings and start an iteration process to determine the best self-consistent borehole and porosity readings based on the above assumptions. It will be appreciated that as the apparent neutron porosity increases, apparent density decreases while the borehole size remains unchanged.

There are many different ways of iterating in order to obtain a solution for the porosity, formation density, and borehole diameter. As an example, suppose that the constants a, b, c, A, B, C, $\rho_{ma}$, $\rho_f$, N and $(\rho_b)_o$ are known for the functions given. Suppose further that the lithology is known. The curve in FIG. 5 corresponding to that lithology can be defined by a relationship of the form $\phi_D = L(\phi_n)$, where L is some function determined by the lithology.

From equation (1)

$$\phi_n = \frac{1}{N} - \frac{BH}{C} \cdot \frac{a}{(BH - B)}$$

Then from equation (4)

$$(\rho_b)_o = \frac{(BH - B)}{A}\rho_{ma} - L\frac{1}{N} - \frac{BH}{C} \cdot \frac{a}{(BH - b)} \cdot (\rho_{ma} - \rho_f) + \frac{BH}{C}$$

This expression has the general form $$BH = F(a,b,c,A,B,C,N.(\rho_b)_o, BH),$$

where "F" indicates the general functional dependence. It is well known that such equations can be solved by iteration. A typical iterative procedure would be to supply an initial estimation for BH on the right hand side of the equation, then calculate a new estimate for BH from the equation. The new estimate would then be compared to the original estimate. If the two estimates were to differ by less than a preset tolerance, the iterative procedure would be stopped, otherwise, the new estimate would again be inserted into the right hand side of the equation, and a new estimate would be made of BH, which would be compared to the second newest estimate.

The relation $\phi_D = L(\phi_n)$ can be determined from the data presented in a figure such as FIG. 5 using one of a number of standard techniques, such as a least squares technique.

Two caveats are necessary to consider when using this system, namely, if gas is present the system will break down and will not give a self-consistent answer, but this is an answer in and of itself and could help flag the presence of gas in the borehole. Secondly the system works only as long as a reasonable estimate of formation lithology is available. If shale is present, then the shale must be accounted for, in the same manner as in standard wireline logging, before the borehole caliber may be inferred.

It should be noted that there are several types of density measuring tools and resistivity tools which can be used in the present invention. For example, density could be measured by nuclear or acoustic means while resistivity could be measured by short normal, induction or laterolog means. Any resistivity tool would, of course, have to be borehole sensitive.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. A system for determining the caliber of a borehole during drilling operations in an earth formation, comprising:

first means adapted to make a first measurement of a first physical characteristic of an interior property of said formation;

second means adapted to make a second measurement of a second physical characteristic of an interior property of said formation, said second physical characteristic being different from said first physical characteristic;

means for determining the lithology of said formation; and means to compare said first and second measurements and to initiate an interation process based at least in part upon the said determined lithology, to determine a self-consistant borehole caliber.

2. A system according to claim 1 wherein said first measurement is porosity and said second measurement density.

3. A system according to claim 1 wherein one of said first or second means is borehole dependent.

4. A system according to claim 1 wherein at least one of said first or said second means is a neutron tool.

5. A system according to claim 1 wherein said first means is a density measuring tool.

6. A system according to claim 5 wherein said density measuring tool is an active gamma ray tool.

7. A system according to claim 5 wherein said density measuring tool is an acoustic tool.

8. A system according to claim 1 wherein said second means is a porosity measuring tool.

9. A system according to claim 8 wherein said second means is a resistivity tool.

10. A system according to claim 8 wherein said second means is an electromagnetic wave resistivity tool.

11. A system according to claim 1 wherein a change in reading of both said first and said second means is indicative of the presence of gas in said borehole.

12. A system according to claim 1 wherein said first means is a neutron porosity tool and said second means is a density tool.

13. A system according to claim 1 wherein said first means is a neutron porosity tool and said second means is a resistivity tool.

14. A system according to claim 1 wherein said first means and said second means have different operating characteristics thereby providing a cross check on readings.

15. A method for determining the caliber of a borehole during drilling operations in an earth formation, comprising the steps of:

taking a first measurement of a first interior physical property of a formation through which said borehole is passing;

taking a second measurement of a second interior physical property of said formation, said second physical property being different from said first physical property;

determining the lithology of said formation; and comparing said first and second measurements, and based at least in part upon the said determined lithology, initiating an iteration process to determine a self-consistent borehole caliber.

16. A method according to claim 15 wherein said first measurement is a density measurement.

17. A method according to claim 15 wherein said second measurement is a porosity measurement.

18. A method according to claim 15 wherein said lithology determination is made by a seismic survey.

19. A method according to claim 15 wherein said lithology determination is made by offset logs.

20. A method according to claim 15 wherein one of said measurements is made by nuclear means.

21. A method according to claim 15 wherein at least one of said measurements is made by a borehole dependent tool.

* * * * *